US008057013B2

(12) United States Patent
Kwon et al.

(10) Patent No.: US 8,057,013 B2
(45) Date of Patent: Nov. 15, 2011

(54) INK-JET PRINTHEAD AND MANUFACTURING METHOD THEREOF

(75) Inventors: Myong-jong Kwon, Suwon-si (KR); Sung-joon Park, Suwon-si (KR); Moon-chul Lee, Yongin-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 1113 days.

(21) Appl. No.: 11/830,112

(22) Filed: Jul. 30, 2007

(65) Prior Publication Data

US 2008/0170101 A1 Jul. 17, 2008

(30) Foreign Application Priority Data

Jan. 17, 2007 (KR) ..... 10-2007-0005424

(51) Int. Cl.
*B41J 2/135* (2006.01)

(52) U.S. Cl. ..... 347/45; 347/47

(58) Field of Classification Search ..... 347/5, 9, 347/12, 29, 41, 45–47, 64, 67, 71, 83
See application file for complete search history.

(56) References Cited

U.S. PATENT DOCUMENTS

| | | | | |
|---|---|---|---|---|
| 5,212,496 | A * | 5/1993 | Badesha et al. | 347/45 |
| 6,302,523 | B1 | 10/2001 | Smith et al. | |
| 7,434,913 | B2 * | 10/2008 | Suzuki et al. | 347/45 |
| 7,441,871 | B2 * | 10/2008 | Nishijima | 347/47 |
| 7,658,469 | B2 * | 2/2010 | Hino et al. | 347/47 |
| 7,699,441 | B2 * | 4/2010 | Lebens | 347/64 |
| 2003/0169313 | A1 | 9/2003 | Shimomura et al. | |
| 2003/0197758 | A1 | 10/2003 | Sasaki et al. | |
| 2004/0022953 | A1 | 2/2004 | Tomita et al. | |
| 2005/0243129 | A1 | 11/2005 | Kim | |
| 2006/0221129 | A1 | 10/2006 | Silverbrook | |

FOREIGN PATENT DOCUMENTS

| | | |
|---|---|---|
| EP | 0389217 | 9/1990 |
| JP | 5-124199 | 5/1993 |
| JP | 2006-82329 | 3/2006 |
| WO | 2005007411 | 1/2005 |
| WO | 2005007413 | 1/2005 |

OTHER PUBLICATIONS

European Search Report issued Mar. 16, 2010 in EP Application No. 07119758.6.

* cited by examiner

*Primary Examiner* — Thinh Nguyen
(74) *Attorney, Agent, or Firm* — Stanzione & Kim, LLP

(57) ABSTRACT

An inkjet printhead and a method of manufacturing the printhead. The inkjet printhead includes a substrate through which an ink supply passage is formed, a chamber plate stacked on the substrate having an ink chamber filled with ink supplied through the ink supply passage and heating resistors to heat the ink formed in the ink chamber, a nozzle plate formed on the chamber plate and through which a plurality of nozzles through which ink is ejected are formed, and a water repellent layer formed on the nozzle plate, wherein portions of a covalent bond formed by reaction between the material forming the nozzle plate and a hydrolysis material used to form the water repellent layer are discontinuously formed.

21 Claims, 5 Drawing Sheets

INK-JET PRINTHEAD AND MANUFACTURING METHOD THEREOF

CROSS-REFERENCE TO RELATED APPLICATIONS

This application claims the benefit of Korean Patent Application No. 10-2007-0005424, filed on Jan. 17, 2007 in the Korean Intellectual Property Office, the disclosure of which is incorporated herein in its entirety by reference.

BACKGROUND OF THE INVENTION

1. Field of the Invention

The present general inventive concept relates to an inkjet printhead, and more particularly, to an inkjet printhead in which a water repellent layer is formed on a nozzle plate.

2. Description of the Related Art

Ink-ejection methods of an inkjet printer can be classified into an electro-thermal transducer method, which is also called a bubble jet method, and an electro-mechanical transducer method. In the electro-thermal transducer method, a heat source is used to generate bubbles in ink and the ink is ejected using a force generated by the bubbles. In the electro-mechanical transducer method, ink is ejected using a piezoelectric material, wherein the ink is ejected according to a change in volume of the ink caused by a deformation of the piezoelectric material.

In the electro-thermal transducer method, a heater is mounted in a chamber of a printhead to supply heat and a considerably large amount of heat energy is supplied during a very short time period, and thus heat is generated due to the resistance characteristics of the heater. The heat is transferred to the ink that is contacting the heater, and thus the temperature of the water-soluble ink is increased above the boiling point of the ink. When the temperature of the ink is increased above the boiling point, bubbles are formed, and these bubbles pressurize the ink around the bubbles. The pressurized ink is ejected through nozzles due to the difference between the atmospheric pressure and the pressure of the ink. While being ejected onto the paper, the ink forms ink droplets in order to minimize the surface energy of the ink itself.

In the electro-mechanical transducer method, a piezoelectric material is attached to a diaphragm to pressurize a chamber of a printhead. Pressure is provided to a chamber to eject the ink using the piezoelectric characteristic of generating force when a voltage is applied. Thus force is generated according to the applied voltage to transfer pressure into the chamber.

An inkjet printhead includes a nozzle plate having a plurality of nozzles to eject ink. The nozzle plate can be formed of photosensitive epoxy resin using a photolithography method and has a hydrophilic external surface having a contact angle of about 66 degrees.

When the ink is ejected out through the nozzle, ink droplets commonly contaminate areas around the nozzle, which prevents the formation of desired ink droplets and adversely affects the ability of the nozzle to maintain a desired uniform ejection direction of the ink droplets.

Further, if ink contaminates areas around the nozzle after the ink droplets are ejected, the remaining ink may be undesirably transferred to and otherwise contaminate a printing medium, thereby decreasing a printing quality.

SUMMARY OF THE INVENTION

The present general inventive concept provides an inkjet printhead with an increased contact angle by forming a water repellent layer having a water repellent material with a low molecular weight and reacting with a material forming a nozzle plate, and a method of manufacturing the inkjet printhead.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing an inkjet printhead including a substrate through which an ink supply passage is formed, a chamber plate stacked on the substrate having an ink chamber filled with ink supplied through the ink supply passage, a plurality of heating resistors formed on the substrate to heat the ink, a nozzle plate formed on the chamber plate and through which a plurality of nozzles are formed to eject ink, and a water repellent layer formed on the nozzle plate, wherein portions of a covalent bond formed by reaction between the material forming the nozzle plate and a hydrolysis material used to form the water repellent layer are discontinuously formed in the nozzle plate and the water repellent layer.

The water repellent layer may be a silane compound including a reaction group reacting with the nozzle plate and a functional group containing fluorine.

The silane compound may be ethoxy silane containing ethoxy as the reaction group.

The silane compound may include a halogen group as the reaction group.

The functional group may contain fluorine including —$(CF_2)nCF_3$, wherein n is an integer from 3 to 15.

The functional group may contain fluorine including —$(CF_2)nCF_3$, wherein n is an integer from 3 to 15.

The functional group containing fluorine may include —$(CF_2)nCF_3$, wherein n is an integer from 3 to 15.

The water repellent layer may be formed only on an upper surface of the nozzle plate.

The nozzle plate may be formed of epoxy.

The foregoing and/or other aspects and utilities of the present general inventive concept may also be achieved by providing a method of manufacturing an inkjet printhead including preparing a substrate on which heating resistors are formed, forming a plurality of chamber plates and a sacrifice mold layer filled in a space between the chamber plates, forming a nozzle plate to cover the chamber plates and the sacrifice mold layer, forming a water repellent layer on the nozzle plate, thereby portions of a covalent bond formed by reaction between the material forming the nozzle plate and a hydrolysis material forming the water repellent layer being discontinuously formed in the nozzle plate and the water repellent layer, and removing portions of the nozzle plate and the water repellent layer corresponding to a nozzle pattern exposed selectively.

The water repellent layer may be a silane compound having a reaction group reacting with the nozzle plate and a functional group containing fluorine.

The silane compound may be ethoxy silane containing ethoxy as the reaction group.

The functional group containing fluorine may include —$(CF_2)nCF_3$, wherein n is an integer from 3 to 15.

The functional group containing fluorine may include —$(CF_2)nCF_3$, wherein n is an integer from 3 to 15.

The functional group containing fluorine may include —$(CF_2)nCF_3$, wherein n is an integer from 3 to 15.

The water repellent layer may only be formed on an upper surface of the nozzle plate.

The nozzle plate may be formed of epoxy.

The removing of portions of the nozzle plate and the water repellent layer, the water repellent layer may be removed together with the nozzle plate.

The foregoing and/or other aspects and utilities of the present general inventive concept may also be achieved by providing a substrate including a plurality of chamber plates separated by a space, a sacrifice mold layer formed in the space between the chamber plates, a nozzle plate formed on a top of the chamber plates and the sacrifice mold layer, a water repellent layer formed on a top of the nozzle plate, and an aperture layer having a plurality of apertures formed on top of the water repellent layer to shield a first portion of the water repellent layer and to expose a second portion of the water repellent layer, such that the second portion becomes less susceptible to removal thereof when irradiated through the aperture layer and then baked and exposed to a solvent.

The foregoing and/or other aspects and utilities of the present general inventive concept may also be achieved by providing an inkjet printhead including a substrate having a plurality of chamber plates separated by a space, a plurality of heaters formed in the space, a nozzle plate formed on a top of the chamber plates having a plurality of nozzles to communicate ink through the nozzle plate, and an ink repellent layer formed on a top of the nozzle plate, wherein the ink is stored in the space, heated by the plurality of heaters, expelled from the space by the plurality of nozzles, and repelled by the ink repellent layer.

The foregoing and/or other aspects and utilities of the present general inventive concept may also be achieved by providing a method of manufacturing an inkjet printhead including forming a plurality of chamber plates separated by a space on a substrate, forming a sacrifice mold layer in the space between the chamber plates, forming a nozzle plate on a top of the chamber plates and the sacrifice mold layer, forming a water repellent layer on a top of the nozzle plate, applying a radiation to an aperture layer and through the apertures therein to a first area of the water repellent layer, removing the aperture layer; and removing the first area of the water repellent layer.

The removing the aperture layer and the removing the first area of the area of the water repellent layer may be performed simultaneously by abutting the aperture layer and the water repellent layer together.

The removing the first area of the water repellent layer may include removing an adjacent area of the nozzle plate.

The removing the aperture layer and the removing the first area of the water repellent layer may be performed simultaneously and may include removing an adjacent area of the nozzle plate.

The removing the first area of the water repellent layer may include heating a second area of the water repellent layer.

The method may further include removing the sacrifice mold layer.

The aperture layer may be disposable.

The aperture layer may be reusable.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
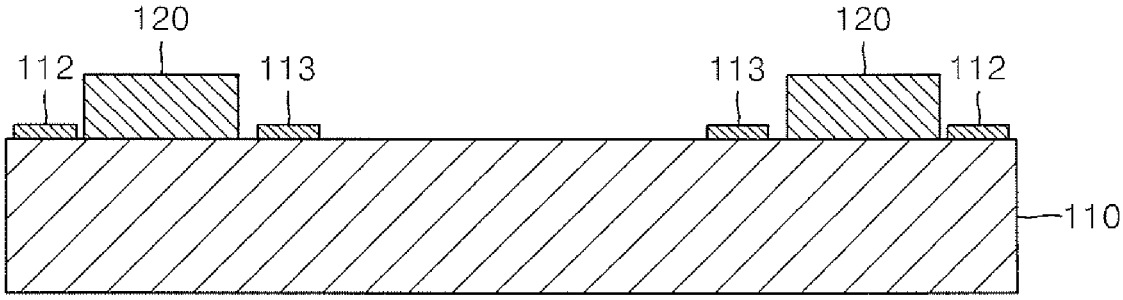
FIGS. 1 through 6 are cross-sectional views illustrating a method of forming an inkjet printhead in which a water repellent layer is formed, according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIGS. 1 through 6 are cross-sectional views illustrating a method of forming an inkjet printhead in which a water repellent layer is formed, according to an embodiment of the present general inventive concept.

Referring to FIG. 1, a substrate 110 is provided, which may be a silicon substrate. A plurality of heat resistors 113 to heat ink for an ink ejection are formed on the substrate 110. A plurality of conductive pads 112 are formed on the substrate to electrically connect the heat resistors 113. Though not illustrated in FIG. 1, wires may be formed to supply electric signals to the heat resistors 113.

A plurality of chamber plates 120 are formed on the substrate 113 to surround the heat resistors 113 and to guide the movement of ink. The chamber plate 120 may be formed of a negative photosensitive resin or thermosetting resin.

Figure 2:
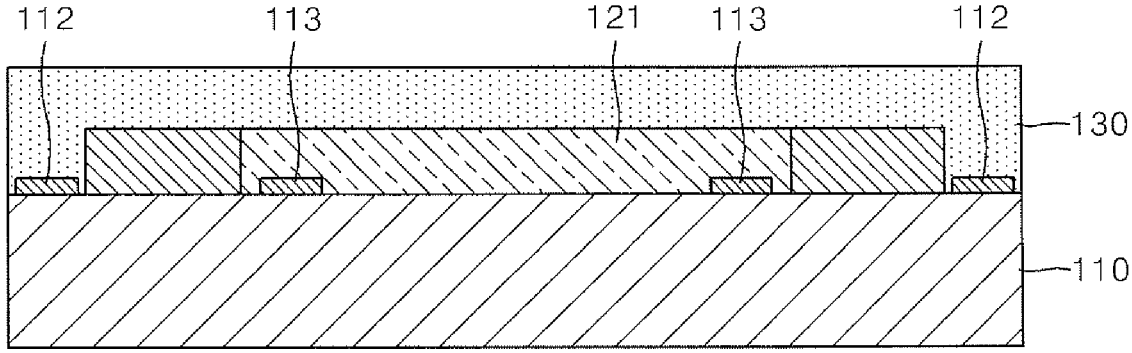
Figure 6:
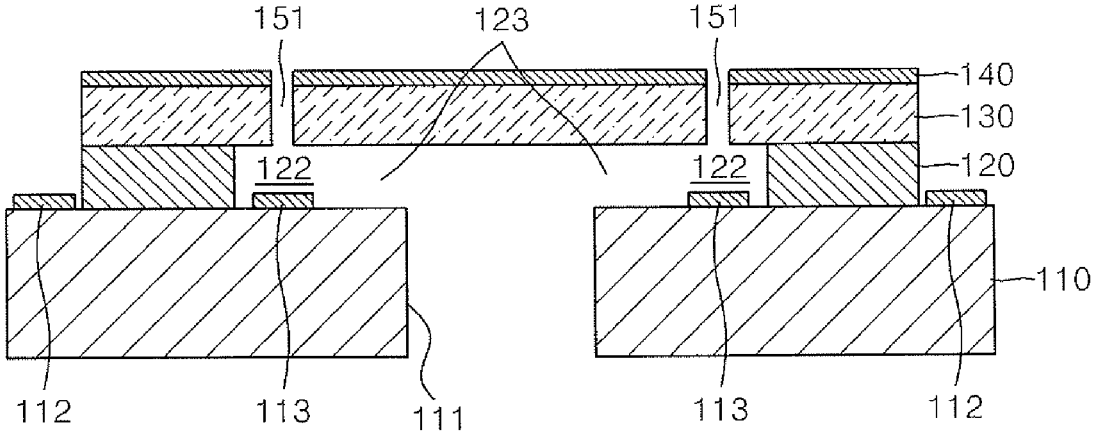

Referring to FIGS. 2 and 6, a sacrifice mold layer 121 is formed in an ink chamber 122 between the chamber plates 120. While the exemplary embodiment employs a fill-up, expansion process in which the chamber plates 120 are formed first and then the sacrifice mold layer 121 is formed, the present general inventive concept is not limited thereto and may employ a process whereby the sacrifice mold layer 121 is formed first followed by formation of the chamber plates 120. The fill-up process is a well known technique and further description thereof will be omitted.

A nozzle plate 130 is formed on the substrate 110 on which the chamber plates 120 and the sacrifice mold layer 121 are formed. The nozzle plate 130 may be formed of a photosensitive resin layer. The negative photosensitive resin layer may be an epoxy resin. The nozzle plate 130 may be formed using a spin coating method.

Figure 3:
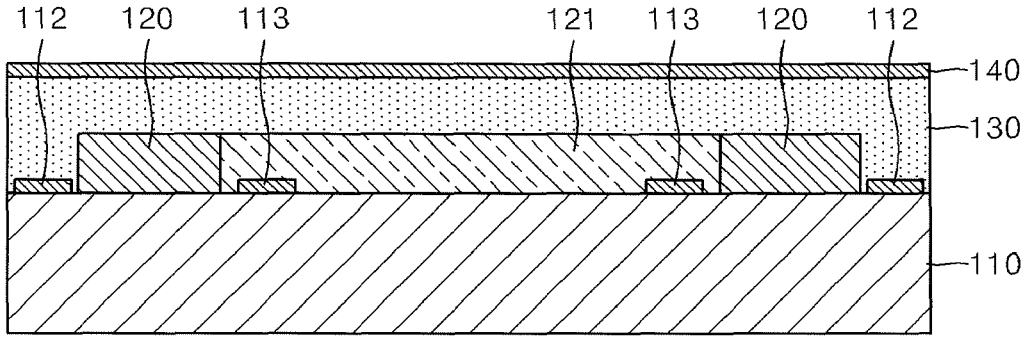

Referring to FIG. 3, a water repellent layer 140 can be formed to repel liquid away from the water repellent layer 140. Such liquids may include, but are not limited to water, ink, and other liquids that might the inkjet printhead may be exposed to during manufacture, installation, and usage thereof. The water repellent layer 140 is formed on the nozzle plate 130 using a contact printing method, a spin coating method, or an evaporation coating method.

The water repellent layer 140 can be formed of a silane compound having a non-photosensitive reaction group and a functional group containing fluorine.

A fluorine silane compound using an alkoxy group as the reaction group in the exemplary embodiment uses fluorine silane represented by Formula 1 below:

[Formula 1]

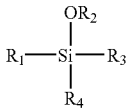

In Formula 1, $R_1$ is a fluorine functional group, and is —$(CF_2)nCF_3$ (where n is an integer from 1 through 15), —$CH_2CF_3$ or —OC(=O)$CF_3$, $R_2$ is a methyl group or an ethyl group, $R_3$ and $R_4$ are each selected from the group consisting of halogen atom, methoxy group, ethoxy group, ethyl group, and methyl group.

$OR_2$ is alkoxy group, which is a reaction group. Thus, when $R_2$ is a methyl group, $OR_2$ is methoxy group and when $R_2$ is an ethyl group, $OR_2$ is an ethoxy group.

The reaction group may be a halogen group.

In the exemplary embodiment, the nozzle plate 130 and a water repellent layer 140 are combined by the dehydration condensation reaction result of the epoxy resin of the nozzle plate 130 and the hydrolysed result of the fluorine silane of Formula 1 of the water repellent layer 140. In the air, the epoxy resin includes a hydroxyl group (—OH) at an end, and the hydroxyl group and the reaction group (—$OR_2$) of the hydrolysis fluorine silane react to undergo a hydrolysis condensation reaction. Thus, portions of a covalent bond formed by the hydrolysis condensation reaction are discontinuously formed in the nozzle plate 130 and the water repellent layer 140, thereby forming spaces between the portions of the covalent bonds.

The reaction group ($R_1$) containing fluorine is an oligomer or monomer having a linear chain structure, and thus the nozzle development agent can permeate through the water repellent layer 140. Accordingly, nozzles can be easily patterned in the nozzle plate 130.

As described above, the nozzle plate 130 and the water repellent layer 140 are connected by a covalent bond, thereby having excellent adhesive force.

For example, the water repellent layer 140 may be formed of DS-5110 from the DURASUF™ DS-5000 series, which is a water repelling agent that is available from Japanese Harves Co., Ltd., coated using a spin coating method, and pre-baked on a hot plate at 85° C. for 30 minutes.

Figure 4:
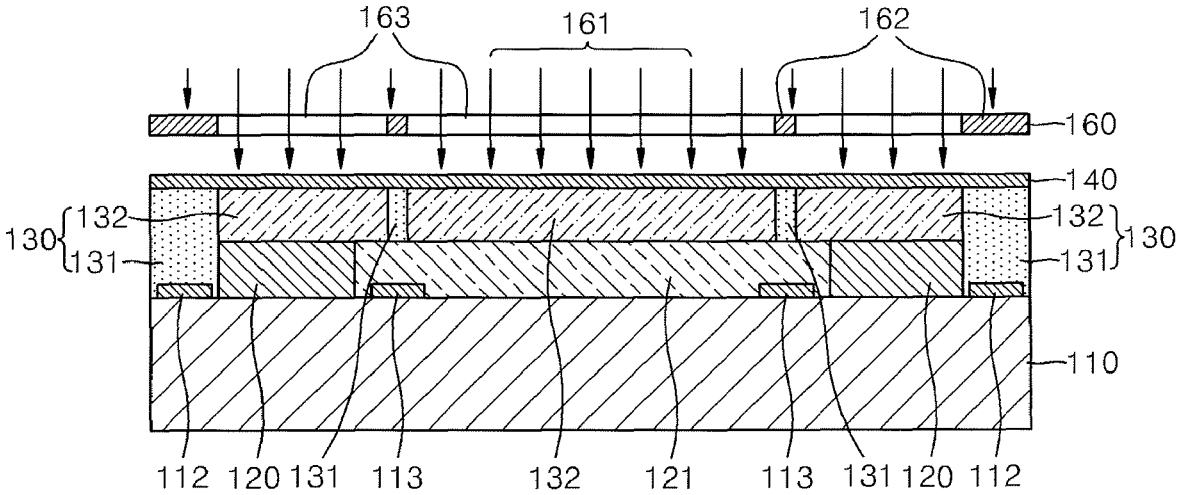

Referring to FIG. 4, a photomask 160, on which a nozzle pattern is formed and having abutment surfaces 162 and apertures 163, is covered on the nozzle plate 130 on which the water repellent layer 140 and ultraviolet rays 161 are irradiated and selective exposure is performed. The abutment surfaces 162 abut the nozzle plate 130 while the apertures 163 allow ultraviolet rays 161 to pass therethrough, thus providing selective irradiation of only specific areas of the nozzle plate 130. The irradiation renders an exposed portion 132 of the nozzle plate less susceptible to removal thereof by a solvent-application process described further below. A pattern masking both sides of the chamber plates 120 may be further formed on the photomask 160 together with the nozzle pattern.

Accordingly, after exposing the nozzle plate 130, a non-exposed portion 131 and the exposed portion 132 (see FIG. 4) are defined on the nozzle plate 130.

The exposed portion 132 of the nozzle plate 130 is heated during a heat-treatment process, such as a post exposure bake (PEB) process which is performed after exposure in a photolithography process. The heat-treatment process bakes the exposed portion 132 onto the substrate 110.

Figure 5:
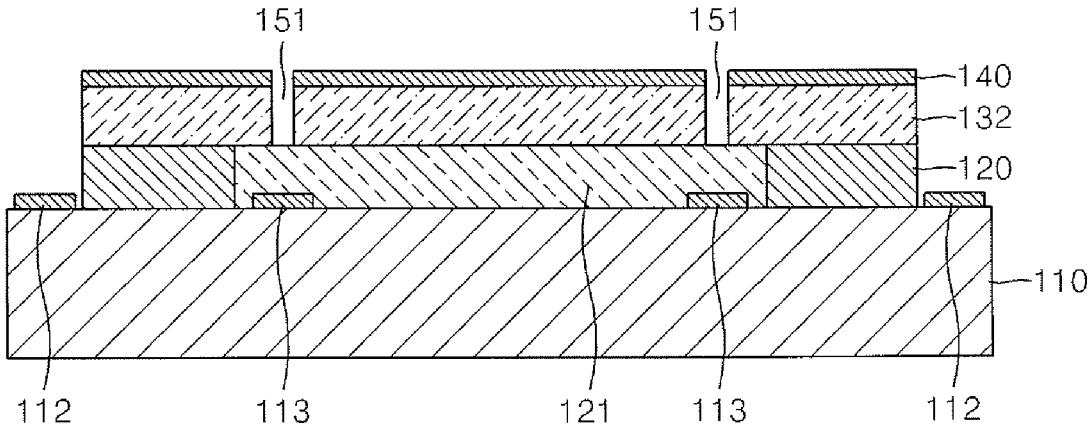

Referring to FIG. 5, the non-exposed portion 131 (see FIG. 4) of the nozzle plate 130 is removed, and can be easily using a solvent.

The solvent-application process utilizes a solvent, which is the developing agent, to pass through the water repellent layer 140 and permeate to the nozzle plate 130 to facilitate removal of the non-exposed portion 131 of the nozzle plate 130.

To render the removal of the non-exposed portion 131 more efficient, the non-exposed portion 131 may be removed simultaneously with the photomask 160. That is, upon abutting, covering, and exposing the nozzle plate 130, as described above, the photomask 160 can be maintained in an abutted position against the nozzle plate 130 throughout the irradiation, heat-treatment and/or solvent-application processes, and then removed from the nozzle plate 130 with the non-exposed portion 131 attached to the photomask 160. If the photomask 160 is reusable, then the non-exposed portion 131 is removed from the photomask 160 via a manual removal or an automatic removal, and can be performed using a device such as a non-exposed portion 131 ejecting device. If the photomask 160 is disposable, then the photomask 160 and the removed non-exposed portion 131 are disposed of accordingly. The abutment surfaces 162 may have an adhesive in order to lock onto the nozzle plate 160 and facilitate removal of the non-exposed portion 131.

Since the non-exposed portion 131 of the nozzle plate 130 is removed, the water repellent layer 140 formed on the non-exposed portion 131 is also lifted off and thus removed simultaneously. The portion of the water repellent layer 140 formed on the exposed portion 132 is not affected and remains on the exposed portion 132. A nozzle 151 to eject ink is formed at the point where the non-exposed portion 131 and the water repellent layer 140 on the non-exposed portion 131 are removed.

Since the nozzle plate 130 includes the water repellent layer 140 selectively on the top surface of the nozzle plate 130, the contact angle on the top surface of the nozzle plate 130 is more durable than the contact angle of the inside of the nozzle, which does not include the water repellent layer 140.

Referring to FIG. 6, after removing the non-exposed portion 131 and the water repellent layer 140 formed thereon, an ink supply passage 111 is formed through the substrate 110. The ink supply passage 111 can be formed using a typical anisotropic dry etching process. The sacrifice mold layer 121 can then be removed using a suitable solvent. Accordingly, an ink passage including an ink chamber 122 and a restrictor 123 is formed in the space where the sacrifice mold layer 121 is removed.

The contact angle of a water repellent material of the water repellent layer 140 in the ink printhead is measured to be approximately 105 degrees. This indicates that a wettability factor is lowered relative to the printhead before application of the water repellent layer 140 having a contact angle measured to be 66 degrees. Although ink is spread to the outside of and into the inner surface of the nozzle 151 on the inner nozzle surface, which is not treated with a water repellent layer, ink is prevented from being smeared on the outer surface of the nozzle 151 due to the outer surface being treated with the water repellent layer 140. As such, the ink only gathers inside the nozzle 151.

Figure 7:
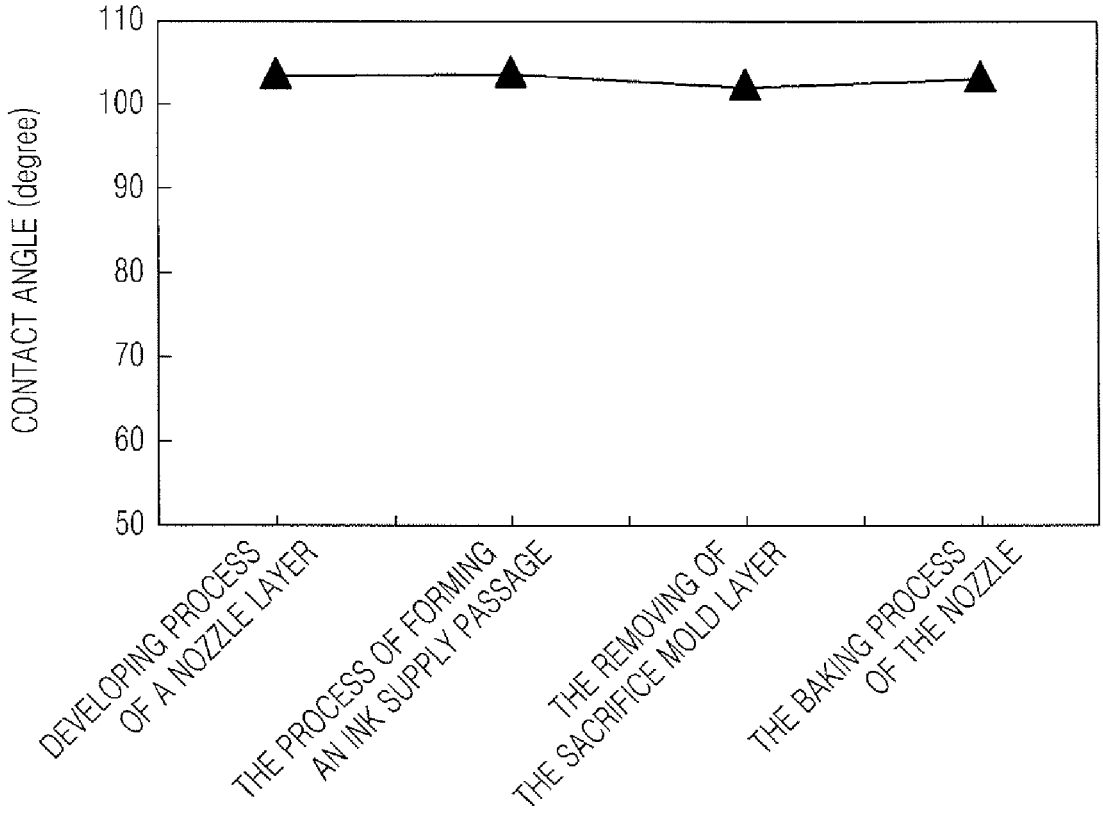
FIG. 7 is a graph illustrating variation in contact angle of a water repellent layer according to a manufacturing process of an inkjet printhead including the water repellent layer according to an exemplary embodiment of the present general inventive concept.

FIG. 7 is a graph illustrating change in contact angle of a water repellent layer according to a manufacturing process of an inkjet printhead including the water repellent layer according to an exemplary embodiment of the present general inventive concept.

Referring to FIG. 7, a variation of the contact angle in different atmospheres is measured while varying the developing process of a nozzle layer, the process of forming an ink supply passage, the removing of the sacrifice mold layer 121, and the baking process of the nozzle 151.

As illustrated in FIG. 7, the contact angle is maintained at substantially the same degrees almost without variation while undergoing these processes. Accordingly, the inkjet printhead having the water repellent layer 140 formed of a water repellent material according to the present general inventive concept has good durability for each atmosphere of the processes.

Figure 8:
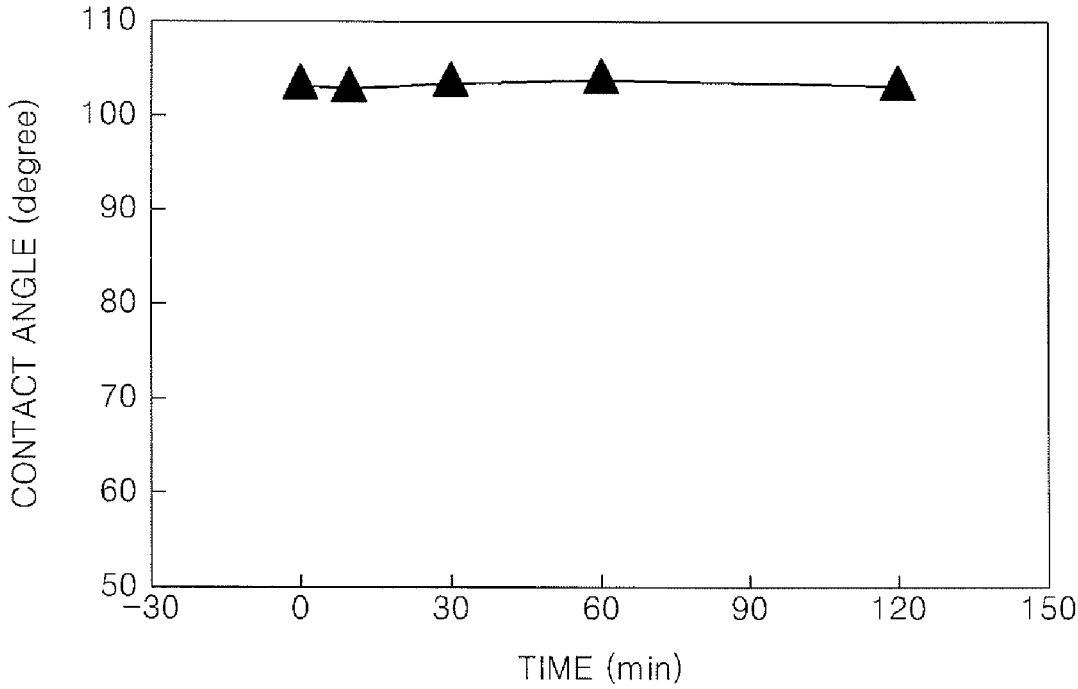
FIG. 8 is a graph illustrating thermal stability of the surface of the water repellent layer according to time.

FIG. 8 is a graph illustrating thermal stability of the surface of the water repellent layer 140 with time.

Referring to FIG. 8, in subsequent processes after the developing process of the nozzle layer, the surface of the nozzle plate is set at a high temperature. As illustrated in FIG. 8, the contact angle illustrates almost zero variation even when the surface of the nozzle is exposed at 190° C. for 2 hours. Accordingly, as can be seen, the water repellent layer according to the present general inventive concept has good thermal stability.

Figure 9:
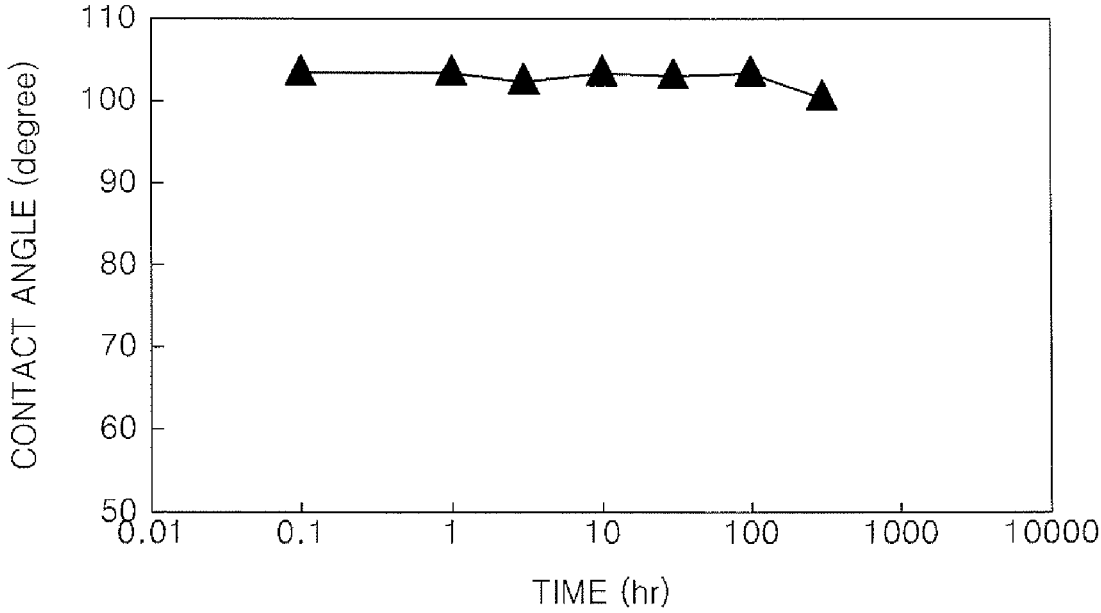
FIG. 9 is a graph illustrating variation in contact angle with respect to ink on the surface of the water repellent layer.

FIG. 9 is a graph illustrating change in contact angle with respect to ink on the surface of the water repellent layer.

Referring to FIG. 9, the variation of the contact angle of the water repellent layer after exposing the surface of the nozzle plate 130 to ink at 70° C. for 300 hours was observed. As illustrated in FIG. 9, the contact angle of the water repellent layer showed almost no variation with respect to time. Accordingly, the water repellent layer according to the present general inventive concept has good durability with respect to ink.

As described above, the inkjet printhead according to the present general inventive concept has the following advantages.

First, the water repellent layer is discontinuously formed on the top surface of the nozzle plate, and thus ink can be sprayed out in a form of complete droplets. Thus the complete ink droplets precisely land on paper in a uniform distribution, thereby increasing the printing quality.

Second, a meniscus formed around the outlet of the nozzle after the ink is sprayed, is quickly stabilized, thus air bubbles are prevented from flowing into the ink chamber, and contamination of the surface around the nozzle is also prevented.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. An inkjet printhead comprising:

a substrate through which an ink supply passage is formed;

a chamber plate stacked on the substrate having an ink chamber filled with ink supplied through the ink supply passage;

a plurality of heating resistors formed on the substrate to heat the ink;

a nozzle plate formed on the chamber plate and through which a plurality of nozzles are formed to eject ink; and a water repellent layer formed on the nozzle plate, wherein portions of a covalent bond formed by reaction between the material forming the nozzle plate and a hydrolysis material used to form the water repellent layer are discontinuously formed in an area between the nozzle plate and the water repellent layer surrounding the plurality of nozzles.

2. The inkjet printhead of claim 1, wherein the water repellent layer is a silane compound comprising a reaction group reacting with the nozzle plate and a functional group containing fluorine.

3. The inkjet printhead of claim 2, wherein the silane compound is ethoxy silane containing ethoxy as the reaction group.

4. The inkjet printhead of claim 3, wherein the functional group containing fluorine includes —$(CF_2)nCF_3$, wherein n is an integer from 3 to 15.

5. The inkjet printhead of claim 2, wherein the silane compound comprises a halogen group as the reaction group.

6. The inkjet printhead of claim 5, wherein the functional group containing fluorine includes —$(CF_2)nCF_3$, wherein n is an integer from 3 to 15.

7. The inkjet printhead of claim 2, wherein the functional group containing fluorine includes —$(CF_2)nCF_3$, wherein n is an integer from 3 to 15.

8. The inkjet printhead of claim 1, wherein the water repellent layer is formed only on an upper surface of the nozzle plate.

9. The inkjet printhead of claim 1, wherein the nozzle plate is formed of epoxy.

10. A method of manufacturing an inkjet printhead comprising:

preparing a substrate on which heating resistors are formed;

forming a plurality of chamber plates and a sacrifice mold layer filled in a space between the chamber plates;

forming a nozzle plate to cover the chamber plates and the sacrifice mold layer;

forming a water repellent layer on the nozzle plate, thereby portions of a covalent bond formed by reaction between the material forming the nozzle plate and a hydrolysis material forming the water repellent layer being discontinuously formed in an area between the nozzle plate and the water repellent layer surrounding a nozzle pattern; and removing portions of the nozzle plate and the water repellent layer corresponding to a nozzle pattern exposed selectively.

11. The method of claim 10, wherein the water repellent layer is a silane compound having a reaction group reacting with the nozzle plate and a functional group containing fluorine.

12. The method of claim 11, wherein the silane compound is ethoxy silane containing ethoxy as the reaction group.

13. The method of claim 12, wherein the functional group containing fluorine includes —$(CF_2)nCF_3$, wherein n is an integer from 3 to 15.

14. The method of claim 11, wherein the functional group containing fluorine includes —$(CF_2)nCF_3$, wherein n is an integer from 3 to 15.

15. The method of claim 10, wherein the functional group containing fluorine includes —$(CF_2)nCF_3$, wherein n is an integer from 3 to 15.

16. The method of claim 10, wherein the water repellent layer is formed only on an upper surface of the nozzle plate.

17. The method of claim 10, wherein the nozzle plate is formed of epoxy.

18. The method of claim 10, wherein in the removing of portions of the nozzle plate and the water repellent layer, the water repellent layer is removed together with the nozzle plate.

19. An inkjet printhead comprising:

a first structure to transfer and store ink;

a nozzle structure formed on the first structure, the nozzle structure including a plurality of nozzles to eject ink; and a water repellent layer formed on the nozzle structure, wherein covalent bonds form due to a reaction between a first material of the nozzle structure and a second material of the water repellent layer, and wherein the covalent bonds are discontinuously formed in an area between the nozzle structure and the water repellent layer surrounding the plurality of nozzles.

20. The inkjet printhead according to claim 19, further comprising:

a plurality of heating resistors formed in the first structure to heat the ink and eject the ink.

21. The inkjet printhead according to claim 19, wherein the first structure comprises:

a substrate through which an ink supply passage is formed; and a chamber plate stacked directly upon the substrate having an ink chamber filled with ink supplied through the ink supply passage.

* * * * *